US011674777B2

(12) United States Patent
Banducci

(10) Patent No.: US 11,674,777 B2
(45) Date of Patent: Jun. 13, 2023

(54) ADJUSTABLE BALLISTIC GARMENT

(71) Applicant: United Shield International LLC, Traverse City, MI (US)

(72) Inventor: Paul Banducci, Traverse City, MI (US)

(73) Assignee: United Shield International LLC, Traverse City, MI (US)

( * ) Notice: Subject to any disclaimer, the term of this patent is extended or adjusted under 35 U.S.C. 154(b) by 100 days.

(21) Appl. No.: 17/225,619

(22) Filed: Apr. 8, 2021

(65) Prior Publication Data

US 2021/0333070 A1 Oct. 28, 2021

Related U.S. Application Data

(63) Continuation of application No. 16/246,992, filed on Jan. 14, 2019, now Pat. No. 10,976,137.

(60) Provisional application No. 62/620,250, filed on Jan. 22, 2018.

(51) Int. Cl.
*F41H 1/02* (2006.01)
*A41D 13/05* (2006.01)

(52) U.S. Cl.
CPC ..... *F41H 1/02* (2013.01); *A41D 13/0518* (2013.01)

(58) Field of Classification Search
CPC ... F41H 1/02; A41D 13/0518; A41D 2400/44; F16G 11/02; F16G 11/12
See application file for complete search history.

(56) References Cited

U.S. PATENT DOCUMENTS 4,697,285 A * 10/1987 Sylvester ..... F41H 1/02 2/2.5
2012/0167290 A1* 7/2012 Kovacevich ..... F16G 11/14 2/463
2015/0059206 A1* 3/2015 Lovett ..... A43C 11/004 12/142 R

* cited by examiner

*Primary Examiner* — Sally Haden
*Assistant Examiner* — Erick I Lopez
(74) *Attorney, Agent, or Firm* — Honigman LLP

(57) ABSTRACT

An adjustable ballistic garment includes a first panel, an opposing second panel, and a connection assembly configured to releasably and adjustably couple the first panel to the second panel. The first panel has a first end of a strap attached thereto, while a second end of the strap is free-hanging. The second panel includes an adjustable tensioning loop and a rotary tensioning knob configured to adjust a length of the tensioning loop. A first coupling member is attached to a second end of the strap and includes a pin extending therefrom. A second coupling member is formed separately from the tensioning loop and the first coupling member and includes a cavity configured to receive the pin of the first coupling member and channel configured to receive the tensioning loop.

20 Claims, 9 Drawing Sheets

ADJUSTABLE BALLISTIC GARMENT

CROSS-REFERENCE TO RELATED APPLICATIONS

This U.S. patent application is a continuation of, and claims priority under 35 U.S.C. § 120 from, U.S. patent application Ser. No. 16/246,992, filed on Jan. 14, 2019, which claims priority to U.S. Provisional application 62/620,250 filed on Jan. 22, 2018 the disclosure of which is considered part of the disclosure of this application and is hereby incorporated by reference in its entirety.

TECHNICAL FIELD

This disclosure relates to protective ballistic garments. More specifically, this disclosure relates to a protective ballistic vest that is adjustable.

BACKGROUND

Protective, or ballistic vests are typically provided with front and back panels for providing ballistic protection to a torso of a user. Protective vests are conventionally concealed beneath the user's uniform or worn over top of the user's uniform, but present a separate article of clothing from the user's uniform. In the field, it is imperative that a ballistic vest be easy for a user to put on and adjust.

SUMMARY

An adjustable ballistic garment includes a first panel, an opposing second panel, and a connection assembly configured to releasably and adjustably couple the first panel to the second panel. The first panel has a first end of a strap attached thereto, while a second end of the strap is free-hanging. The second panel includes an adjustable tensioning loop and a rotary tensioning knob configured to adjust a length of the tensioning loop. A first coupling member is attached to a second end of the strap and includes a pin extending therefrom. A second coupling member is formed separately from the tensioning loop and the first coupling member and includes a cavity configured to receive the pin of the first coupling member and channel configured to receive the tensioning loop.

DESCRIPTION OF DRAWINGS

Like reference symbols in the various drawings indicate like elements.

DETAILED DESCRIPTION

Figure 1:
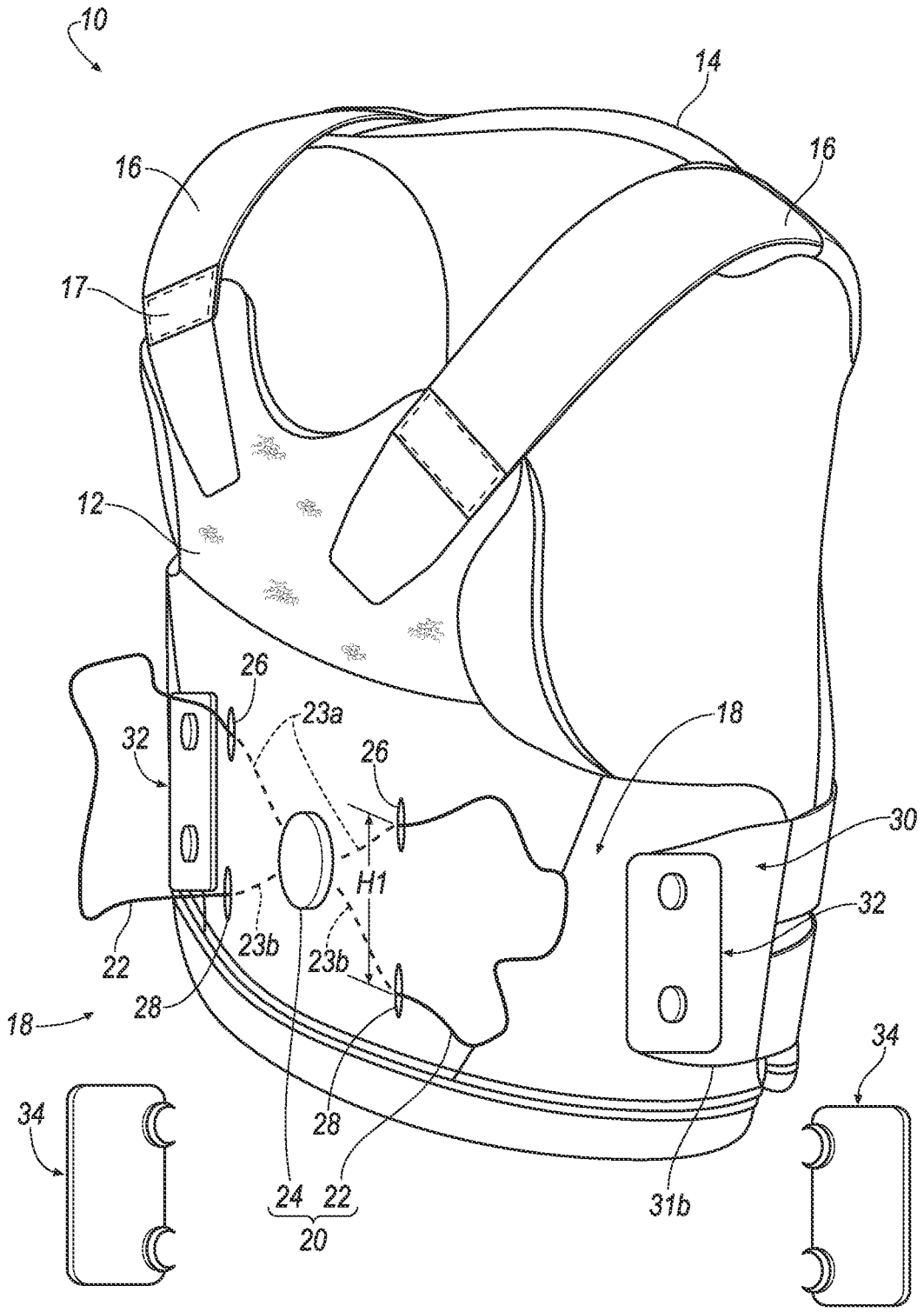
FIG. 1 is a front perspective of a ballistic garment according to the instant disclosure.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, a ballistic vest 10 includes a front panel 12 and an opposing back panel 14. The panels 12, 14 may be formed one or more protective materials, as are known in the art, and may include means, e.g., a slot, opening, etc., to receive a protective material, such as a plate, panel, etc. The front panel 12 may be joined to the back panel 14 by a pair of adjustable shoulder straps 16. In some examples, the shoulder straps 16 may be fixed to a first one of the panels 12, 14, and include an adjustable fastener 17 (e.g., hook and loop, buttons, snaps, magnets) for removably coupling with the second one of the panels 12, 14. Accordingly, the front panel 12 and the back panel 14 may be selectively separable.

Figure 2:
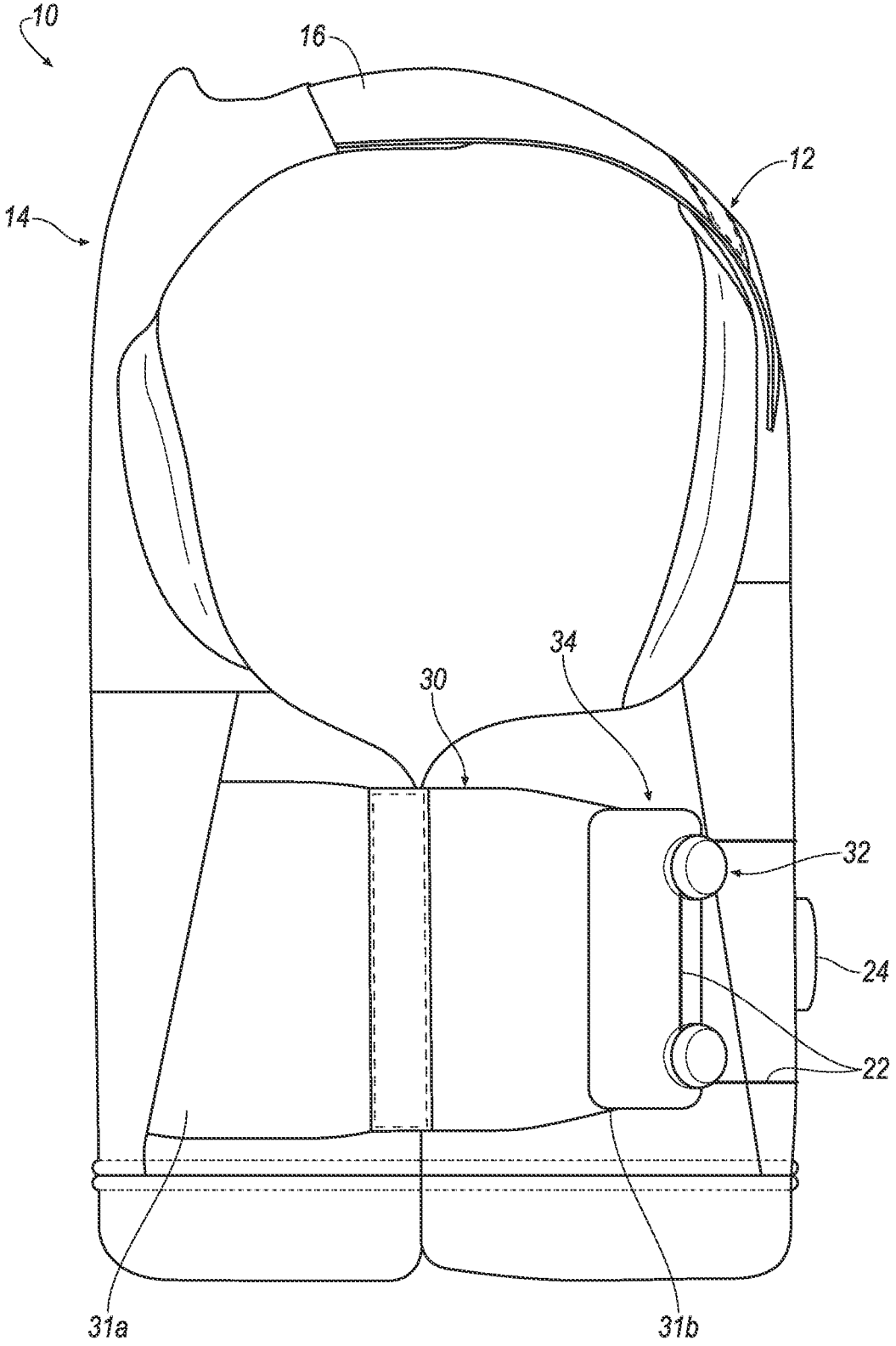
FIG. 2 is a side view of the ballistic vest of FIG. 1.

With reference to FIGS. 1 and 2, the vest 10 includes a connection assembly 18 configured to selectively and adjustably couple opposing sides of the front panel 12 and the back panel 14 to control a fit of the vest 10. In the illustrated embodiment, the vest 10 includes a first connection assembly 18 configured to couple the front panel 12 to the back panel 14 on a first side of the vest 10, and an identical connection assembly 18 configured to couple the front panel 12 to the back panel 14 on an opposite second side of the vest 10. In some examples, the vest 10 may include a single one of the connection assemblies 18 on the first side of the vest 10, while the second side of the vest 10 is fixed. Accordingly, the following description with respect to a single one of the connection assemblies 18 will be understood to apply to each of the first and second connection assemblies 18.

Each connection assembly 18 interfaces with a tensioner 20 disposed on the front panel 12. The tensioner 20 includes a pair of tensioning loops 22 defined by elongate cords connected to a rotary tension knob 24. The tensioning loops 22 are formed of a high-strength cord having at least one end 23*a*, 23*b* coupled to the rotary tensioning knob 24. Accordingly, an effective length of the tensioning loop 22 (i.e., a length of the tensioning loop 22 from the first end 23*a* to the second end 23*b*) is adjustable by rotating the rotary tension knob 24, as illustrated in FIGS. 6C and 6D, and discussed below.

In some examples, opposite ends 23*a*, 23*b* of the tensioning loops 22 are both coupled to the rotary tensioning knob 24. Accordingly, the effective length of the tensioning loop 22 is adjustable at both ends 23*a*, 23*b*. In other examples, a first one of the ends 23*a*, 23*b* of the tensioning loop 22 may be fixed with respect to the front panel 12, while the other end 23*a*, 23*b* is coupled to the rotary tension knob 24. Here, the effective length of the tensioning loop 22 is adjustable at one of the outlet 26 or the inlet 28.

In the illustrated example, the tensioning loops 22 are associated with opposite sides of the vest 10 from each other, whereby a first one of the tensioning loops 22 corresponds to the first side of the vest 10 and the second one of the tensioning loops corresponds to the second side of the vest 10. Each tensioning loop 22 extends from a first outlet 26 to a first inlet 28 formed in the front panel 12. The first outlet 26 and the first inlet 28 may be spaced apart and aligned with each other along a substantially vertical direction (i.e. direction associated with a height of a user). A distance between a center of the outlet 26 and a center of the inlet 28 defines a height H1 of the tensioning loop 22.

Referring to FIGS. 1 and 2, each connection assembly 18 further includes a pair of straps 30 disposed on opposite sides of the vest 10, and each having a first end 31*a* fixed to a lower portion of the back panel 14, which may be associated with a lumbar region of a torso of a user. The first end 31*a*, of the strap 30 may be fixed to the back panel 14 by sewing or adhesives, for example. An opposing second end 31*b* of each strap 30 is free-hanging, and is configured to be selectively coupled to the front panel 12, as described in greater detail below. Each strap 30 may be formed of a flexible material, such as a fabric or polymeric material. In some examples the straps 30 are formed of an elastic fabric material. Additionally or alternatively, the straps 30 may be formed of a substantially inelastic material.

Each of the connection assemblies 18 includes a first coupling member 32 and a second coupling member 34 configured to provide an interface between the free-hanging tensioning loop 22 and the second end 31*b* of the strap 30, whereby a tension of the strap 30 can be adjusted by extending or retracting the loop 22 (i.e., changing the effective length of the tensioning loop 22) using the rotary tension knob 24. As shown in FIGS. 1 and 2, the first coupling member 32 is attached to the second end 31*b* of the strap 30.

Figure 3A:
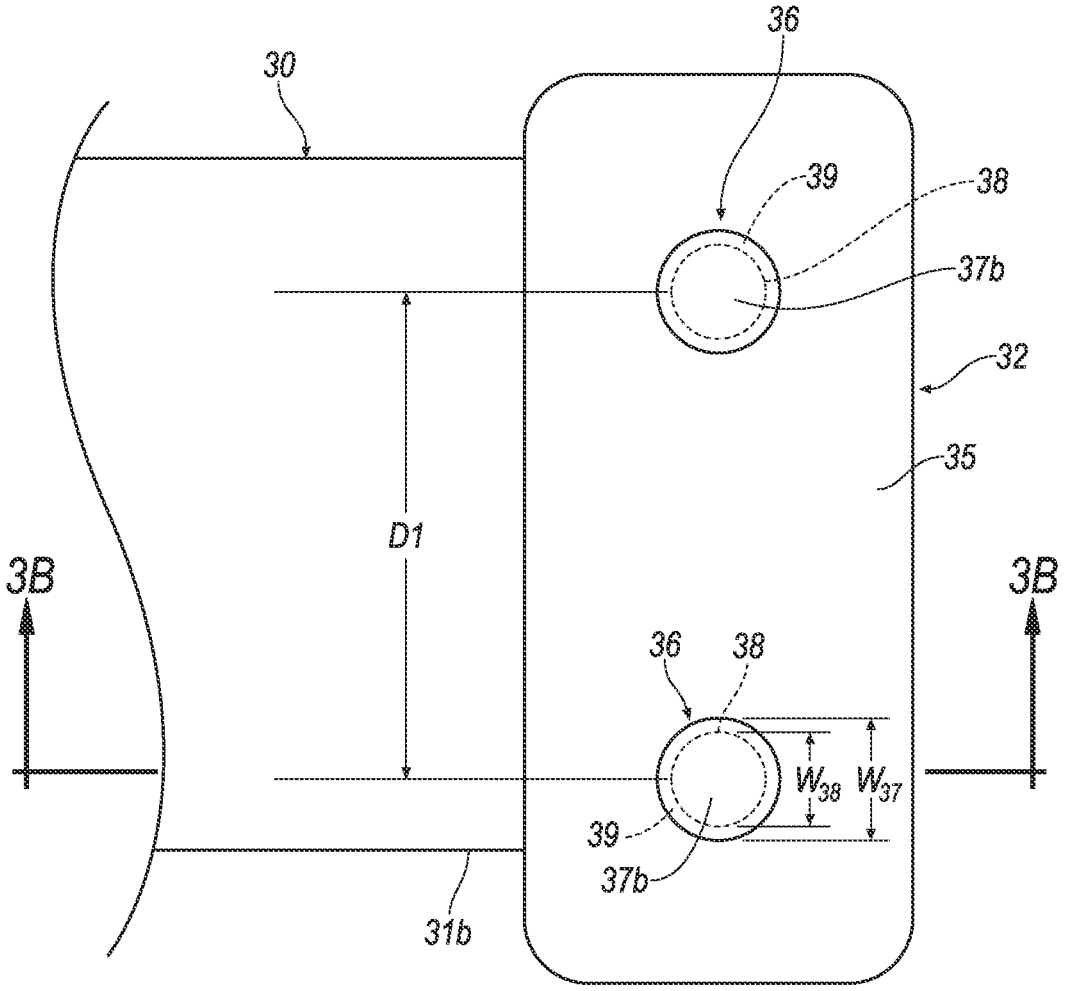
FIG. 3A is an enlarged view of a first coupling member of the ballistic vest of FIG. 1.
Figure 3B:
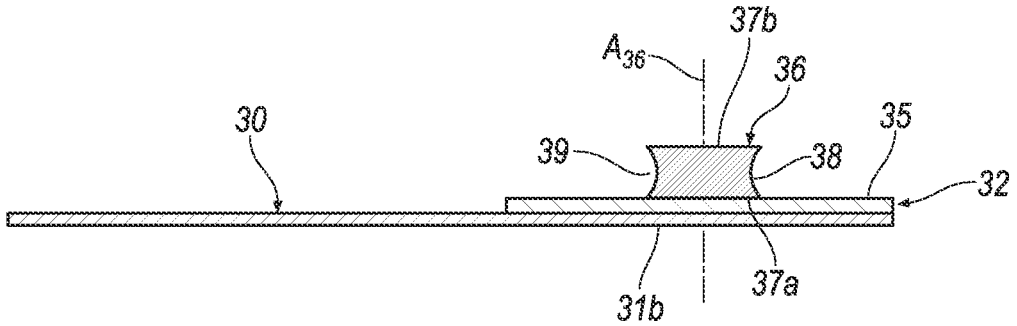
FIG. 3B is a cross-sectional view of the first coupling member of FIG. 1, taken along section line 3B-3B of FIG. 3A.

With reference to FIGS. 3A and 3B, the first coupling member 32 includes a base 35 and one or more pins 36 extending therefrom. As shown, the base 35 is attached to the second end 31*b* of the strap 30. The base 35 may be formed of a material having a greater stiffness than the material of the strap 30, thereby providing a substantially rigid substrate for supporting the pins 36. For example, the base 35 may be formed of a rigid or semi-rigid metal, plastic, or composite material.

In the illustrated example, the first coupling member 32 includes two pins 36 spaced apart from each other in a first direction by a first distance D1. Each pin 36 includes a first end 37*a* attached to the base 35, and a distal second end 37*b* disposed at an opposite end from the first end 37*a*. A peripheral surface 38 extends between the first end 37*a* and the second end 37*b*, and defines an outer peripheral of the pin 36. As shown, the peripheral surface 38 may define a groove 39 extending around the periphery of the pin 36, about a central axis $A_{36}$ of the pin. Particularly, a width $W_{38}$ of the pin 36 at the peripheral surface 38 may be less than the width $W_{37}$ of the pin 36 at the first end 37*a* or second end 37*b*.

As shown in FIG. 3B, the groove 39 has a concave cross-sectional shape that extends at least partially around a circumference of each pin 36. In other examples, the peripheral surface 38 may define a polygonal cross section, and may include a plurality of substantially planar sidewalls arranged around the periphery of the pin 36. Similarly, although a substantially circular pin 36 is illustrated, the pin 36 may include one or more straight sides, and the groove 39 may surround only a portion of the pin 36.

Figure 4A:
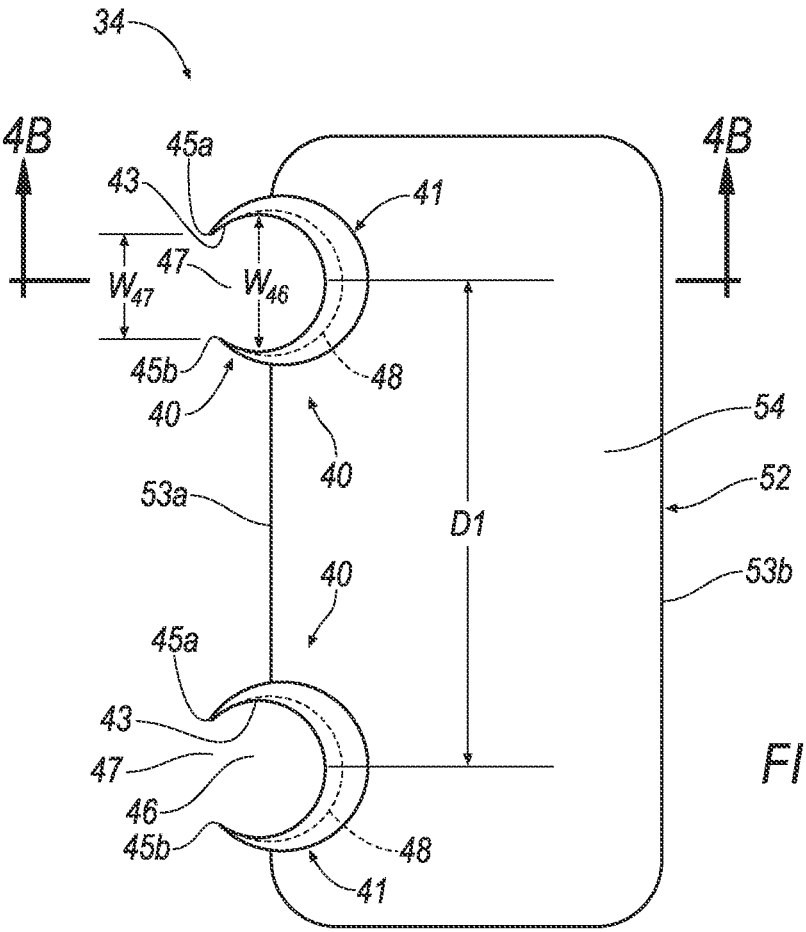
FIG. 4A is an enlarged view of a second coupling member of the ballistic vest of FIG. 1.
Figure 4B:
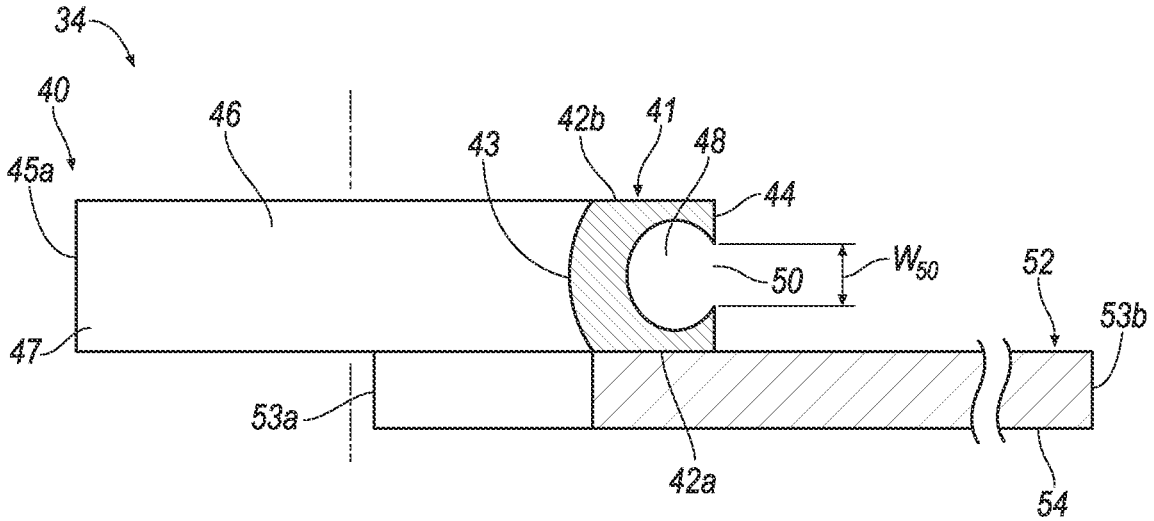
FIG. 4B is a cross-sectional view of a second coupling member of the vest of FIG. 1, taken along section line 4B-4B of FIG. 4A.

With reference to FIGS. 4A and 4B, the second coupling member 34 includes one or more clips 40 attached to a base 52. The clips 40 are configured to interface with the pins 36 of the first coupling member 32. As shown, the clips 40 are defined by a substantially crescent-shaped sidewall 41 having a first end 42*a* attached to the base 52 and a second end 42*b* formed at an opposite end from the first end 42*a*. A distance between the first end 42*a* and the second end 42*b* defines a thickness of the clip 40. Each of the clips 40 includes an inner peripheral surface 43 extending from the first end 43*a* to the second end 43*b*, and an outer peripheral surface 44 formed on an opposite side from the inner peripheral surface 43. The inner peripheral surface 43 and the outer peripheral surface 44 cooperate to define the substantially crescent shaped sidewall 41, whereby the surfaces 43, 44 converge with each other to form opposing ends 45*a*, 45*b* of the sidewall 41. Accordingly, the inner peripheral surface 43 extends along a concave path, while the outer peripheral surface 44 extends along a convex path.

Figure 5A:
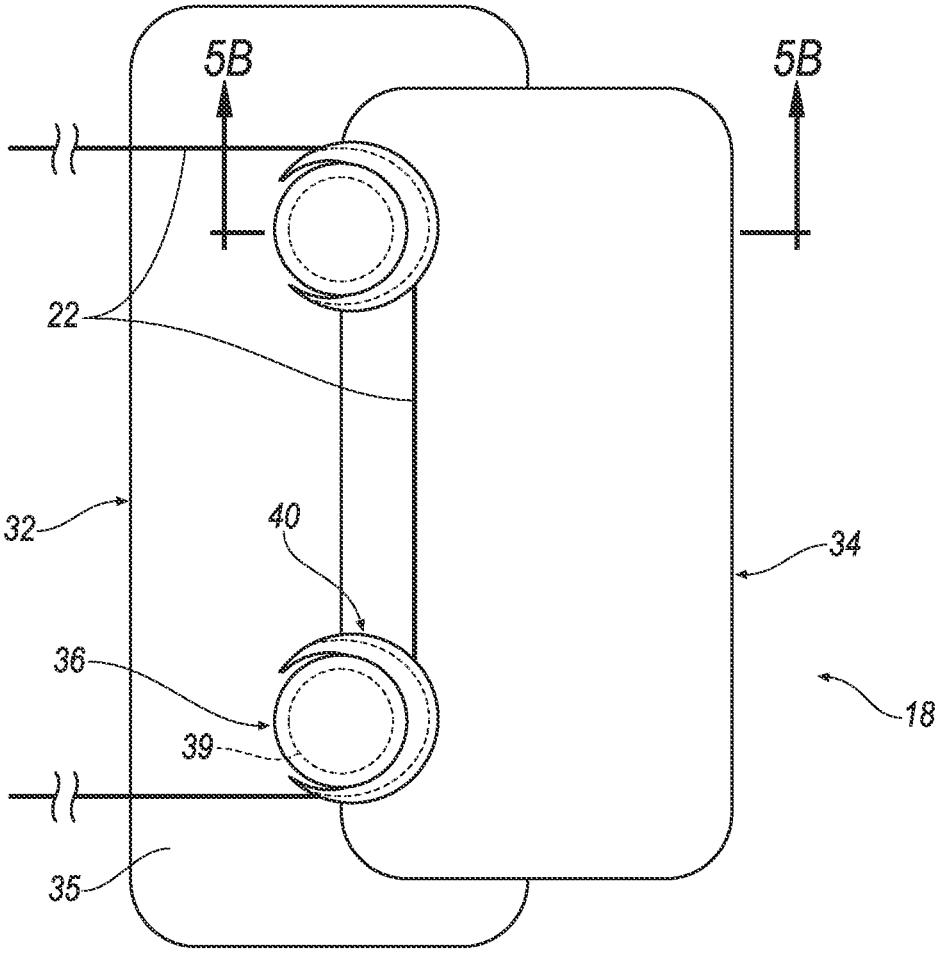
FIG. 5A is an enlarged view of a connection assembly of the ballistic vest of FIG. 1.
Figure 5B:
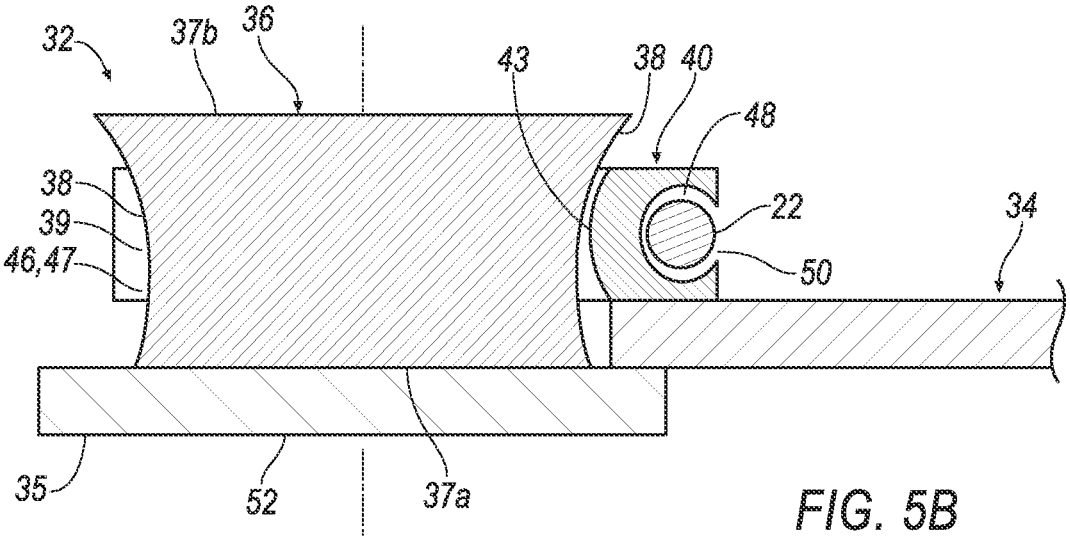
FIG. 5B is a cross-sectional view of the connection assembly of FIG. 5A, taken along section line 5B-5B of FIG. 5A.

The inner peripheral surface 43 defines a substantially cylindrical cavity 46 extending entirely through the thickness of the clip 40 . . . . As shown in FIG. 5B, the inner peripheral surface 43 is configured to interface with the peripheral surface 38 of the pins 36 to couple the second coupling member 34 to the first coupling member 32. As shown, a width $W_{46}$ (i.e. diameter) of the cavity 46 is larger than a corresponding width $W_{38}$ (i.e. diameter) of the pin 36 across an intermediate portion of the peripheral surface 38, and smaller than a widths $W_{37}$ (i.e. diameter) of the ends 37*a*, 37*b* of the pin 36. Accordingly, when the pin 36 is disposed within the cavity 46, the inner peripheral surface 43 is received by and interfaces with the recessed outer peripheral surface 38 of the pin 36, as shown in FIG. 5B. A cross section of the inner peripheral surface 43 of the sidewall 41 may have convex shape configured to interface with the concave peripheral surface 38 of the pin 36.

With continued reference to FIG. 4A, an opening 47 to the cavity 46 is defined by opposing ends 45*a*, 45*b* of the sidewall 41, and may have a width $W_{47}$ that is less than the width $W_{38}$ of the peripheral surface 38 of the pin 36, whereby the ends 45*a*, 45*b* of the sidewall 41 must be biased apart from each other to allow the pin 36 to be inserted into the cavity 46. In some examples the pin 36 may be forced through the opening 47 into the cavity 46 to bias the ends 45*a*, 45*b* apart. Accordingly, the pin 36 may be snapped into the cavity 46 to secure the first coupling member 32 to the second coupling member 34.

With reference to FIG. 4B, the clip 40 further includes a channel 48 formed in the outer peripheral surface 44, on an opposite side of the clip 40 from the cavity 46. The channel 48 is configured to receive the cord of the tensioning loop 22 therein. As shown, the channel 48 includes an opening 50 having a width $W_{50}$ that is less than a diameter of the cord of the tensioning loop 22. Accordingly, the tensioning loop 22 may be secured within the channel 48 by biasing the cord of the loop 22 through the opening 50.

As discussed above, the clips 40 of the second coupling member 34 may be attached to the base 52. In one example, the base 52 is formed of a resilient material, such as leather or rubber, and first ends 42*a* of the clips 40 are joined to the base 52. Alternatively, the clips 40 and the base 52 may be integrally formed of a rigid or semi-rigid material, such as a plastic, metal, composite, or combination thereof. The base 52 may include a handle portion 54, which is configured to be grasped by a user to position or adjust the second coupling member 34. As shown, the clips 40 are disposed adjacent to an inner first edge 53*a* of the base 52, while the handle portion 54 is formed along an outer second edge 53*b* of the base 52, on an opposite side of the base 52 from the first edge 53*a*.

Figure 6A:
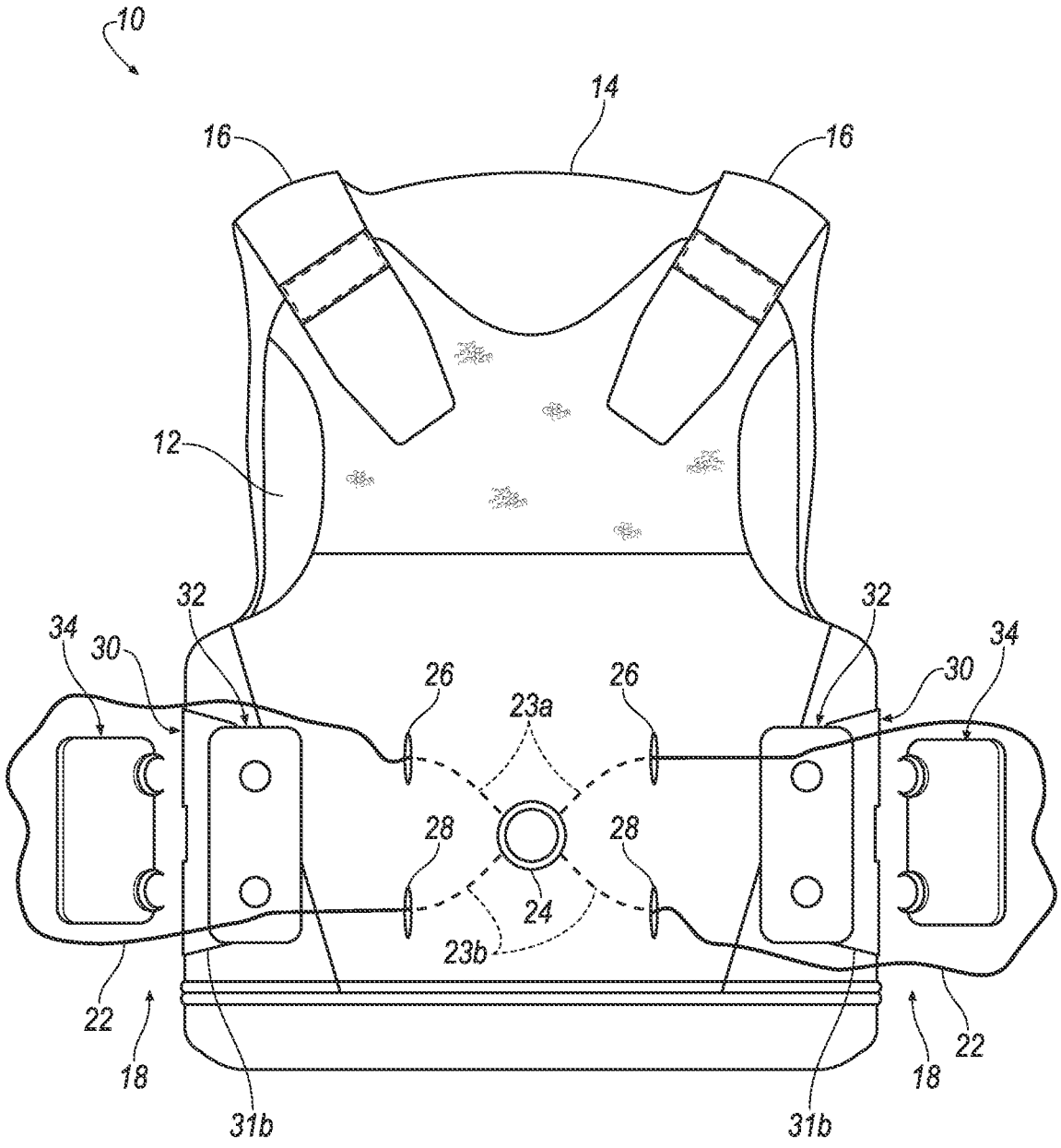
FIGS. 6A-6D are front views of the ballistic vest of FIG. 1, shown in first, second, third, and fourth configurations, respectively.
Figure 6B:
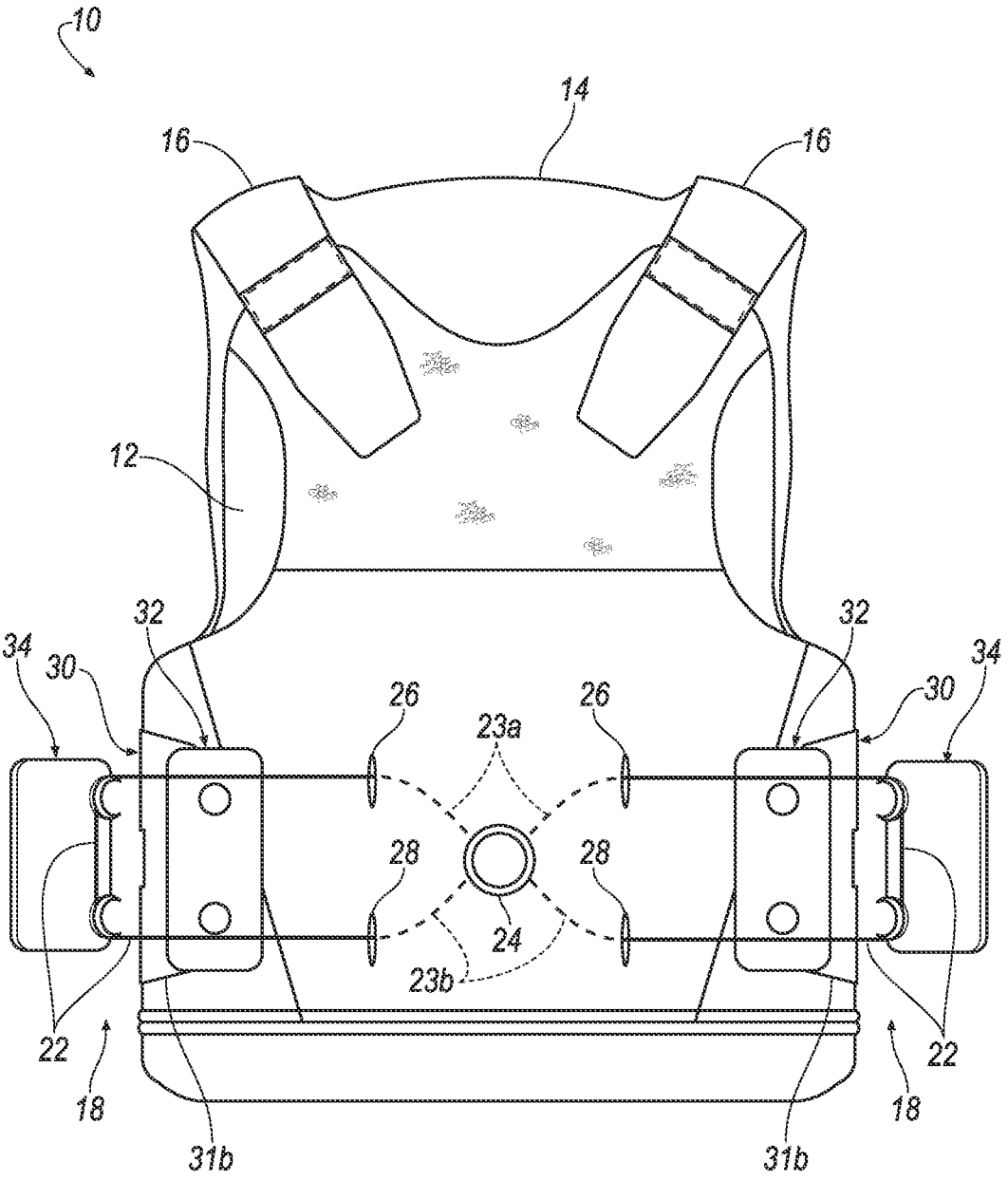
Figure 6C:
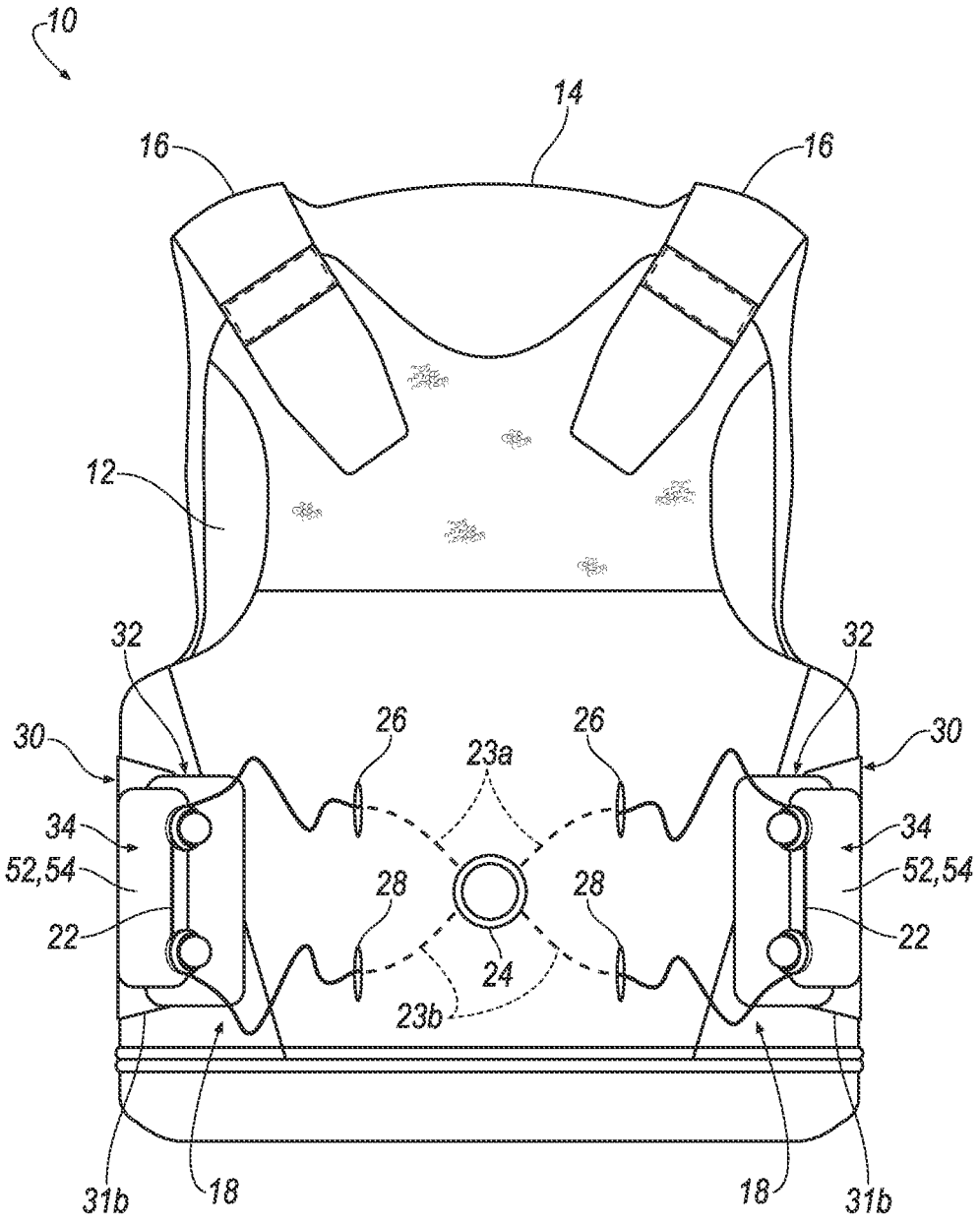
Figure 6D:
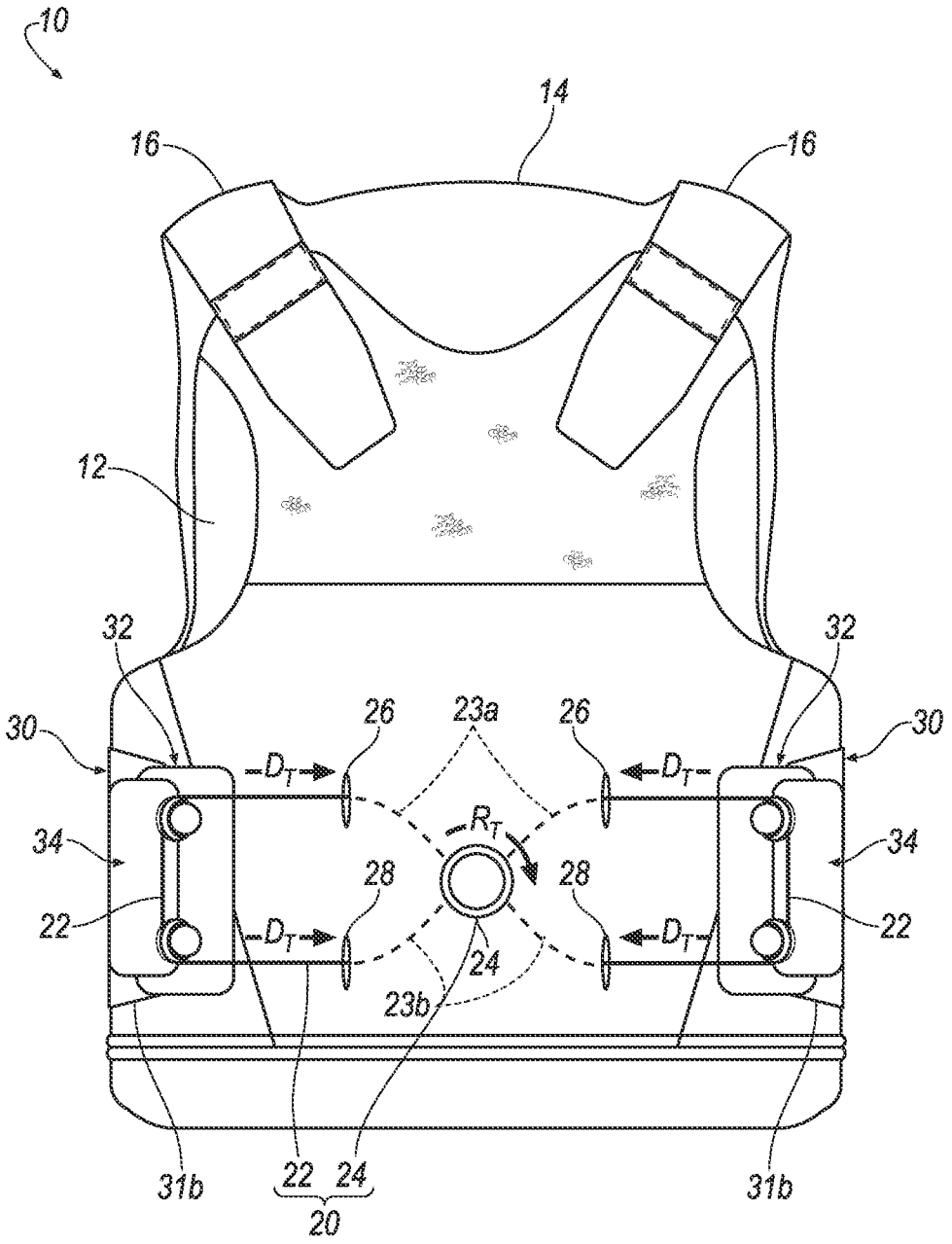

With reference to FIGS. 6A-6D, steps for transitioning the vest from a first configuration (e.g. disassembled) to a second configuration (e.g. assembled and tightened on a user) are illustrated. Initially, as illustrated in FIG. 6A the vest 10 may be provided in a disassembled state, whereby the second coupling members 34 are decoupled from each of the tensioning loops 22 and the first coupling members 32, and each of the tensioning loops 22 and the first coupling members 32 are free-hanging. Furthermore, the tensioning loop 22 is initially provided in an extended position, whereby the effective length the portion of the tensioning loop 22 between the outlet 26 and the inlet 28 is at a maximum length.

Once the vest 10 is positioned on the user, the user or an assistant may couple each tensioning loop 22 to respective ones of the second coupling members 34 by inserting respective portions of the cord of the tensioning loop 22 into the channels 48 of the clips 40, as shown in FIGS. 3A, 3B, and 6B. Accordingly, each tensioning loop 22 extends from a first end 23*a* coupled to the rotary tension knob 24, out of one of the outlets 26, through the channels 48 of respective first and second clips 40, and returns to the rotary tension knob 24 though the inlet 28. As discussed above, the cord of the tensioning loop 22 is secured within the channels 48 of the clips 40 by way of the width $W_{50}$ of the opening 50 being smaller than a thickness of the cord of the tensioning loop 22. Accordingly, the second coupling member 34 is secured to the tensioning loop 22.

With the second coupling member 34 secured to the tensioning loop 22, the user may couple the second coupling member 34 to the first coupling member 32, as shown in FIG. 6C. For example, the user may grasp the handle portion 54 of the second coupling member 34 and align the openings 47 of the clip cavities 46 with the peripheral surfaces 38 of corresponding pins 36. The user may then engage the first coupling member 32 and the second coupling member 34 by forcing the peripheral surfaces 38 of the respective pins 36 through the corresponding openings 47 and into the cavities 46 of the clips 40, whereby the peripheral surface 38 interfaces with the sidewall 41 of the cavity 46.

Because the tensioning loops 22 are secured within the respective channels 48 of the clips 40, the tensioning loops 22 remain engaged with the second coupling members 34, even when the tensioning loops 22 are in a slacked state, as shown in FIG. 6C. Accordingly, the user is able to secure the second coupling members 34 to the first coupling members 32 without further interaction with the tensioning loops 22.

Once the second coupling members 34 are engaged with (i.e., coupled to) the first coupling members 32, the user may adjust the tension of the tensioning loops 22 by rotating the rotary tension knob 24, as indicated by the directional arrow $R_T$ shown in FIG. 6D. As shown, the tensioning loops 22 move in a tightening direction DT and are retracted within the outlet 26 and/or inlet 28 of the vest 10 such that effective lengths of the tensioning loops 22 are minimized. Accordingly, the tensioning loops 22 pull the second coupling members 34 towards the center of the vest 10. Because the second coupling members 34 are engaged with the first coupling members 32, which are respectively attached to the second ends 31*b* of the straps 30, the second ends 31*b* of the straps 30 are consequently pulled towards the center of the vest 10 to tighten the vest 10 around the user. As shown in FIG. 5B, each clip 40 of the second coupling members 34 is disposed between the tensioning loop 22 and a pin 36 of the first coupling member 32. Accordingly, when the tensioning loop 22 is retracted within the vest 10, the tensioning loop 22 compresses the inner peripheral surface 43 of the clip 40 against the outer peripheral surface 38 of the pin 36 to maintain the pin 36 within the cavity 46.

To remove the vest 10, the user may release the tension on the tensioning loop 22 by disengaging the rotary tension knob 24. With the tension released in the tensioning loop 22, the user may disengage the second coupling member 34 from the first coupling member 32 by pulling on the handle portion 54 of the second coupling member 34, thereby allowing the second end 31*b* of the strap 30 to fall free, and for the vest 10 to be removed.

The operation of the vest may be done to quickly, and easily adjust (i.e., increase or decrease), the girth of the vest to correspond to, for example, a circumference of a user's abdomen. Adjustment of the girth of the vest may be done for a variety of reasons, such as, for example, to accommodate users of different size, weight, etc.

A number of implementations have been described. Nevertheless, it will be understood that various modifications may be made without departing from the spirit and scope of the disclosure. Accordingly, other implementations are within the scope of the following claims.

What is claimed is:

1. An adjustable ballistic garment, comprising:

a first panel;

a second panel opposing the first panel and including a tensioning loop;

a strap having a first end attached to the first panel and a second end including a first coupling member having a pin extending therefrom; and a second coupling member including a clip having a thickness extending from a first end to a second end formed on an opposite side than the first end, the clip including a peripheral sidewall extending from a first terminal end to a second terminal end opposing the first terminal end to define a cavity extending through a thickness of the clip and a first opening, extending between the first terminal end and the second terminal end of the peripheral sidewall into the cavity, wherein the first opening includes a first width measured between the first terminal end and the second terminal end, and the cavity has a second width that is (i) measured parallel to the first width and (ii) greater than the first width.

2. The adjustable ballistic garment of claim 1, wherein the second panel further includes a rotary adjustment knob configured to selectively adjust a length of the tensioning loop.

3. The adjustable ballistic garment of claim 1, wherein the second coupling member includes a substantially cylindrical inner peripheral surface extending from the first end to the second end and defining the cavity.

4. The adjustable ballistic garment of claim 3, wherein the peripheral sidewall of the second coupling member includes an outer peripheral surface extending from the first end to the second end and defining a channel configured to selectively receive the tensioning loop.

5. The adjustable ballistic garment of claim 4, wherein the tensioning loop is formed of a cable having a first thickness, and a second opening into the channel has a width that is less than the first thickness.

6. The adjustable ballistic garment of claim 4, wherein the first opening is formed on first side of the clip and the channel is formed on an opposite second side of the clip.

7. The adjustable ballistic garment of claim 6, wherein the pin includes a recessed outer peripheral surface configured to receive the second coupling member.

8. The adjustable ballistic garment of claim 1, wherein the pin has a third width that is less than the second width.

9. The adjustable ballistic garment of claim 8, wherein the first width of the first opening that is less than the third width.

10. The adjustable ballistic garment of claim 1, wherein the second coupling member includes a handle portion formed on an opposite side of the second coupling member from the clip.

11. A connection assembly for a ballistic vest, comprising:

a tensioner including a tensioning loop adjustably coupled to a rotary tensioning knob;

a first coupling member including at least one pin extending therefrom; and a second coupling member including at least one clip, the at least one clip having a peripheral sidewall extending from a first terminal end to a second terminal end opposing the first terminal end to define (i) a cavity extending through a thickness of the clip and configured to receive the at least one pin, and a first opening formed between the first terminal end and the second terminal end the peripheral sidewall of the clip into the cavity, wherein the first opening includes a first width measured between the first terminal end and the second terminal end, and the cavity has a second width that is (i) measured parallel to the first width and (ii) greater than the first width.

12. The connection assembly of claim 11, wherein the at least one pin of the first coupling member includes a peripheral surface recessed from an outer periphery of the pin and configured to receive the clip.

13. The connection assembly of claim 12, wherein the peripheral surface is concave.

14. The connection assembly of claim 11, wherein the at least one pin of the first coupling member includes a first pin and a second pin spaced apart from the first pin by a first distance, and the second coupling member includes a first clip and a second clip spaced apart from the first clip by the first distance, the first pin and the second pin being configured to interface with the first clip and the second clip.

15. The connection assembly of claim 11, wherein the connection assembly is operable between a first configuration having the second coupling member disengaged from each of the tensioning loop and the first coupling member, a second configuration having the second coupling member engaged with the tensioning loop and disengaged from the first coupling member; and a third configuration having the second coupling member engaged with the first coupling member and the tensioning loop.

16. The connection assembly of claim 15, wherein in the third configuration the tensioning loop is removably received within a channel of the second coupling member and the pin of the first coupling member is received within the cavity of the second coupling member.

17. The connection assembly of claim 16, wherein a thickness of the tensioning loop is greater than a width of a second opening into the channel.

18. The connection assembly of claim 15, wherein in the third configuration the second coupling member is interposed between the first coupling member and the tensioning loop.

19. The connection assembly of claim 15, wherein in the third configuration a position of the first coupling member and the second coupling member is adjustable by rotating the rotary tensioning knob.

20. The connection assembly of claim 11, wherein the first width of the first opening is less than a third width of the pin (ii) and the second width of the cavity is greater than the first width of the pin.

* * * * *